United States Patent [19]

Klatt et al.

[11] Patent Number: 4,539,840

[45] Date of Patent: Sep. 10, 1985

[54] SOOTBLOWING SYSTEM WITH IDENTIFICATION OF MODEL PARAMETERS

[75] Inventors: John H. Klatt, Laurel, Md.; Thomas J. Scheib, Chesterland, Ohio

[73] Assignee: The Babcock & Wilcox Company, New Orleans, La.

[21] Appl. No.: 551,455

[22] Filed: Nov. 14, 1983

[51] Int. Cl.[3] ..... G01L 3/26

[52] U.S. Cl. ..... 73/112; 15/316 A; 122/390

[58] Field of Search ..... 73/112; 122/379, 390, 122/391, 392; 15/316 R, 316 A

[56] References Cited

U.S. PATENT DOCUMENTS 2,948,013 8/1960 Bearer, Jr. ..... 15/316 A 3,396,706 8/1968 Rayburn ..... 122/390 X

*Primary Examiner*—Jerry W. Myracle

*Attorney, Agent, or Firm*—Vytas R. Matas; Robert J. Edwards

[57] ABSTRACT

A method of identifying a parameter of a model for a rate of loss of boiler efficiency due to a sootblowing operation, in a boiler having a plurality of heat traps, comprises measuring a time since a last sootblowing operation in the heat trap in question, measuring an overall boiler efficiency at the beginning of sootblowing for the heat trap in question, measuring a change in efficiency due to the sootblowing operation and calculating the parameter using an equation. According to the equation, the ratio of efficiency change over overall boiler efficiency equals the time factor since the last sootblowing operation times the parameter minus a summation of factors for each of the other heat traps and their associated sootblowing operations. The technique is extendable to individual sootblowers within a heat trap by using fouling rate index rather than overall boiler efficiency.

6 Claims, 7 Drawing Figures

SOOTBLOWING SYSTEM WITH IDENTIFICATION OF MODEL PARAMETERS

FIELD AND BACKGROUND OF THE INVENTION

The present invention relates, in general, to fossil fuel boilers and, in particular, to a new and useful method and arrangement for optimizing scheduled timing of sootblowing in such boilers.

The combustion of fossil fuels for the production of steam or power, generates a residue broadly known as ash. All but a few fuels have solid residues, and in some instances, the quantity is considerable.

For continuous operation, removal of ash is essential. In suspension firing the ash particles are carried out of the boiler furnace by the gas stream and form deposits on tubes in the gas passes (fouling). Under some circumstances, the deposits may lead to corrosion of these surfaces.

Some means must be provided to remove the ash from the boiler surfaces since ash in its various forms may seriously interfere with operation or even cause shutdown. Furnace wall and convection-pass surfaces can be cleaned of ash and slag while in operation by the use of sootblowers using steam or air as a blowing medium. The sootblowing equipment directs product steam through retractable nozzles aimed at the areas where deposits accumulate.

The convection-pass surfaces in the boiler, sometimes referred to as heat traps, are divided into distinct sections in the boiler, e.g. superheater, reheater, and economizer sections. Each heat trap normally has its own dedicated set of sootblowing equipment. Usually, only one set of sootblowers is operated at any time, since the sootblowing operation consumes product steam and at the same time reduces the heat transfer rate of the heat trap being cleaned.

Scheduling and sequencing of sootblowing is usually implemented with timers. The timing schedule is developed during initial operation and startup of the boiler. In addition to timers, critical operating parameters, such as gas side differential pressure, will interrupt the timing schedule when emergency plugging or fouling conditions are detected.

The sequencing, scheduling, and optimizing of the sootblowing operation can be automated by using controls. See U.S. Pat. No. 405,840 now abandoned filed Aug. 6, 1982 and entitled SOOTBLOWING OPTIMIZATION, which is here incorporated by reference.

The scheduling is usually set by boiler cleaning experts who observe boiler operating conditions and review fuel analyses and previous laboratory tests of fuel fouling. The sootblower schedule control settings may be accurate for the given operating conditions which were observed, but the combustion process is highly variable. There are constant and seasonal changes in load demand and gradual long term changes in burner efficiency and heat exchange surface cleanliness after sootblowing. Fuel properties can also vary for fuels such as bark, refuse, blast furnace gas, residue oils, waste sludge, or blends of coils. As a result, sootblowing scheduling based on several days of operating cycles may not result in the most economical or effective operation of the boiler.

Present practice for sootblowing scheduling is based on the use of timers. The timing schedule is developed during initial operation and startup, and according to the above application, can be economically optimized for constant and seasonal changes in load demand, fuel variations, and gradual long term changes in burner efficiency and heat exchange surface cleanliness after sootblowing.

A boiler diagnostic package which can be used for sootblowing optimization has been proposed by T. C. Heil et al in an article entitled "Boiler Heat Transfer Model For Operator Diagnostic Information" given at the ASME/IEEE Power Gen. Conference in October 1981 at St. Louis, Mo. The method depends upon estimates of gas side temperatures from coupled energy balances, and the implementation requires extensive recursive computations to solve a series of heat trap equations.

As noted, various approaches have been developed to optimize the use of sootblowing equipment. A method by Klatt and Matsko computes optimum sootblowing schedules using a model of boiler fouling characteristics which is adapted on-line. An identification of the rate of change of total boiler efficiency versus time ("fouling rate") is computed for multiple groupings of sootblowers in the various heat traps using only a measure of relative boiler efficiency. Using this information, the economic optimum cycle times for sootblower operation are predicted.

For the above scheme and others similar to it, a critical part of the computation is the identification of the "fouling rates". A major problem in this identification is the interaction of the effects due to multiple heat trap operations. Klatt and Matsko have assumed these effects to be negligible in their scheme, while other methods require a large number of additional inputs attempting to account for these interactions. For some combustion units with sootblowers, neglecting multiple heat trap interactions is valid (i.e., utility boilers). However, for many units sootblowing is a continuous procedure and a method of accounting for the interactions is necessary. This method should be implemented without adding a large number of expensive inputs.

SUMMARY OF THE INVENTION

An object of the present invention is to provide a method and means of identifying the "fouling rate" of multiple sootblower groups for all types of combustion units. The identification can be done using combinations of "fouling rate" models for different heat traps, or any generalized set or grouping of sootblowers, as well as being applied to methods in which only one model type is assumed.

According to the invention, the identification is accomplished using only a relative boiler or heat trap efficiency measurement, and does not require additional temperature inputs from throughout the boiler or heat trap. Also, the implementation of this invention can be accomplished in microprocessor-based equipment such as the NETWORK 90 controller module. (NETWORK 90 is a trademark of the Bailey Controls Division of Babcock and Wilcox, a McDermott company).

Another object of the invention is to provide a method of identifying a parameter of a model for a rate of loss of boiler efficiency due to a sootblowing operation in one of a plurality of heat traps or groupings within a boiler which comprises measuring the time since a last sootblowing operation in the heat trap (or grouping) in question, measuring an overall boiler efficiency at a beginning of the sootblowing operation for that heat trap (or grouping), the overall boiler efficiency being due to all heat traps present, measuring the change in efficiency in the boiler due to the sootblowing operation in the heat trap or grouping in question and calculating the parameter using an equation which relates the change in efficiency due to a particular sootblowing operation, to the overall efficiency of the boiler.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
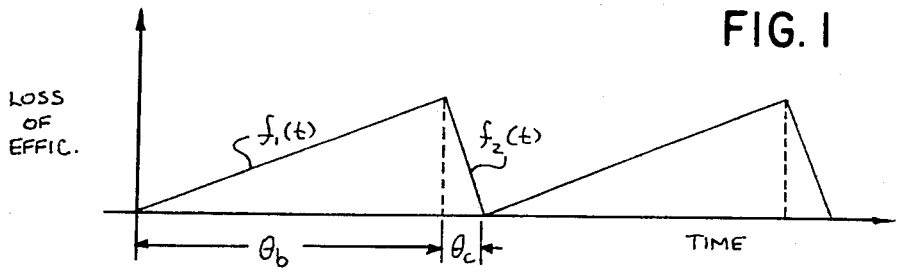
FIG. 1 is a graph showing loss of efficiency due to fouling plotted against time and illustrating the effect of a sootblowing operation in a single heat trap of a boiler.

Referring to the drawings in particular, the invention provides for a method of calculating or identifying parameters of multiple models for the rate of loss of total boiler efficiency due to the cleaning of individual heat traps of the boiler by a sootblowing operation.

In a boiler (not illustrated), a plurality of heat traps are usually provided which lie in series with respect to a flow of combustion gases. For example, immediately above a combustion chamber platelets are provided which are followed, in the flow direction of the combustion gases, by a secondary superheater, a reheater, a primary superheater, and an economizer. Continuing in the flow direction, the flow gases are then processed for pollution control and discharged from a stack or the like.

Sootblowing equipment is operated as groupings (by reaction or region) so that portions of the boiler can be cleaned by sootblowing at spaced times while the boiler continues to operate. Each sootblowing operation, however, has an adverse effect on the overall efficiency of the boiler, during the sootblowing operation proper. The sootblowing operation, by reducing fouling, ultimately increases the efficiency of the particular heat trap being serviced.

As shown in FIG. 1, fouling rate models can be established which share the loss of efficiency over a period of time after a sootblowing operation, as the heat trap becomes fouled. The symbol $\theta_b$ is the time since the sootblower last rain in a boiler having only a single heat trap. The time $\theta_c$ is the time during which the sootblowing operation takes place. The loss of efficiency since the last sootblowing operation is a function of time as is the change in efficiency (increase) during the sootblowing operation. These functions for these two periods can be written as follows:

$$f_1(t)=a_1\theta_b^N$$

$$f_2(t)-b_1\theta_c$$

where $a_1$ and $b_1$ are model parameters and N=a coefficient for the fouling rate model.

While these functions are illustrated as being linear, they need not be so.

Figure 2:
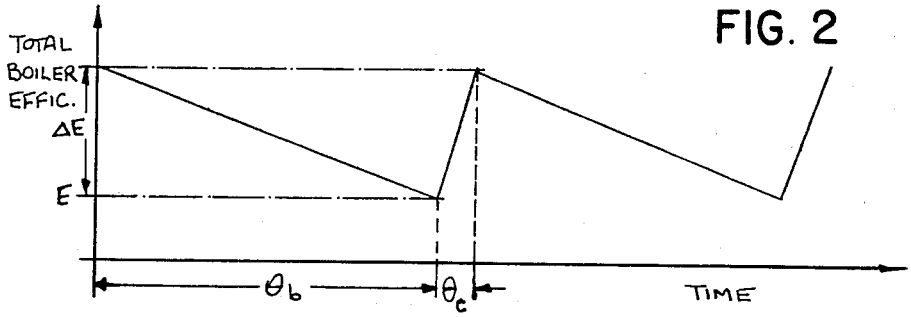
FIG. 2 is a graph showing the change in overall boiler efficiency plotted against time during fouling and sootblowing operations in a single heat trap.

For a boiler having only one grouping trap, the identification of the adjustable model variable $a_1$ is easily done. By simply measuring the change in total boiler efficiency due to sootblowing, the model can be evaluated as shown in FIG. 2 and in accordance with the relationship:

$$a_1 = -\frac{\Delta E_1}{E\theta_b^N}$$

where $\Delta E_1$ is the change of overall boiler efficiency due to a sootblowing operation and E is the overall boiler efficiency since the beginning of the last sootblowing operation.

For systems with multiple heat traps, however, the identification of the various parameters $a_i$, for the various heat traps in the models become difficult. Klatt and Matsko assume, for a system in which the time for sootblowing is much less than times at which no sootblowing takes place, the identification method can be the same as for a single heat trap. For systems in which this is not the case, however, a more involved calculation must be used.

Figure 3:
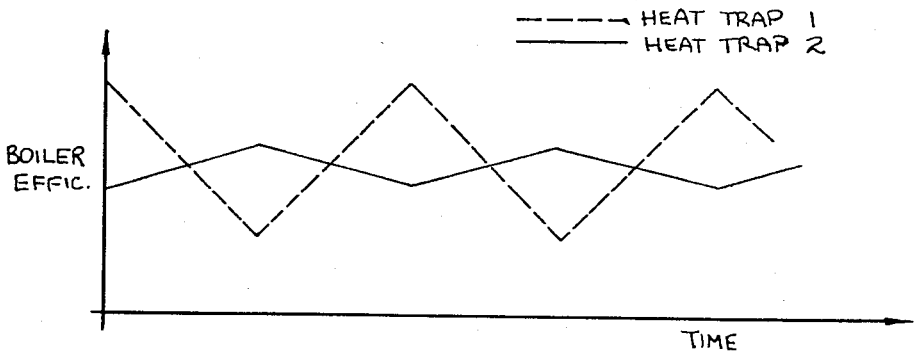
FIG. 3 is a graph showing boiler efficiency plotted against time for two separate heat traps.
Figure 4:
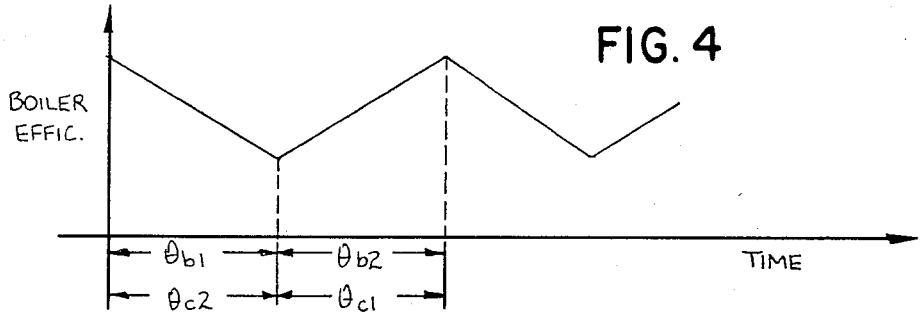
FIG. 4 is a graph showing the overall efficiency of the boiler of FIG. 3 which includes two heat traps.

FIG. 3 illustrates the case where two heat traps are provided and shows the effect of boiler efficiency due to these two traps separately. From outside the boiler, however, where the overall efficiency is measured, a composite curve is observed as illustrated in FIG. 4. The parameters $a_i$ for the $i^{th}$ heat trap, in the model, can be calculated from measuring this change and overall efficiency. The relationships for two heat traps with linear fouling models can be written:

$$-\Delta E_1/E=a_1\theta b1-a_2\theta_{c1}$$

$$-\Delta E_2/E=-a_1\theta_{c2}+a_2\theta_{b2}$$

where $\Delta E_2$ is the change in efficiency due to sootblowing in the second heat trap $\theta_{c2}$ is the time for sootblowing the second heat trap and $\theta_{b2}$ is the time since the last sootblowing in the second heat trap.

These various periods of time are illustrated in FIG. 4.

It is noted that the parameter a will be calculated as negative with direct application of the method at line 24, of page 7. Negative which implies the cleaning of the second heat trap leads to a decrease in boiler efficiency. In reality, the decrease in boiler efficiency due to the fouling of the first heat trap off-sets the cleaning of the second heat trap, which is shown accounted for in the previous equations.

Figure 5:
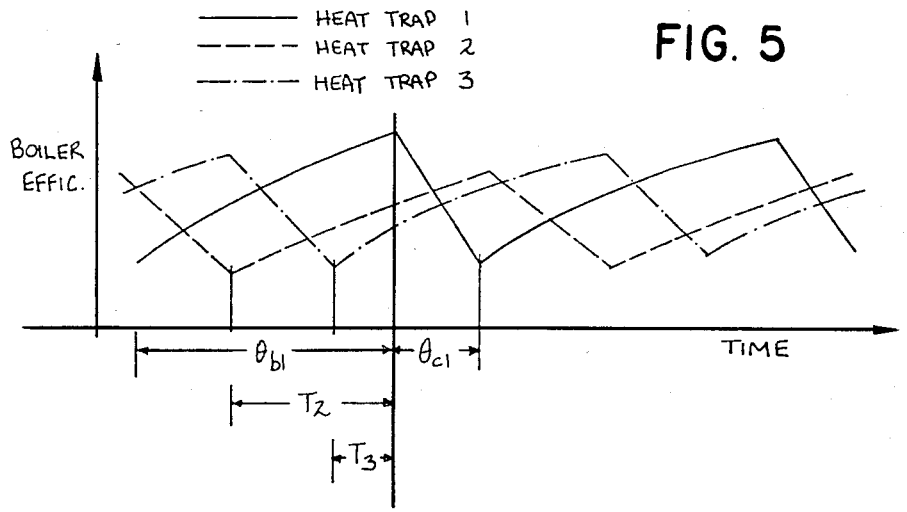
FIG. 5 is a graph plotting loss of efficiency against time for three heat traps in a boiler.

The fouling model for a boiler having three heat traps is illustrated in FIG. 5. The above analysis can be expanded and generalized by any number of heat traps with variable model types as follows:

$$-\Delta E_i/E = a_i\theta_{bi}^{Ni} - \sum_{\substack{j=1\\ j\neq i}}^{m} a_j((T_j + \theta_{ci})^{Nj} - T_j^{Nj})$$

Where $\Delta E_i$ is the change in efficiency due to sootblowing in the $i^{th}$ heat trap or group of blowers and j is more than one (that is, a heat trap or group other than the heat trap for which the parameters $a_i$ is being calculated) and $T_j$ is the time since sootblowing in the $j^{th}$ heat trap.

For three traps therefore as shown in FIG. 5, the equation for the first heat trap becomes:

$$-\Delta E_1/E = a_1\theta_{b1}^{N1} - ((T_2 + \theta_{c1})^{N2} - T_2^{N2})a_2 - ((T_3 + \theta_{c1})^{N3} - T_3^{N3})a_3$$

The method of the present invention can be implemented using the NETWORK 90 as a microprocessor for effecting the various required steps and manipulations.

Figure 6:
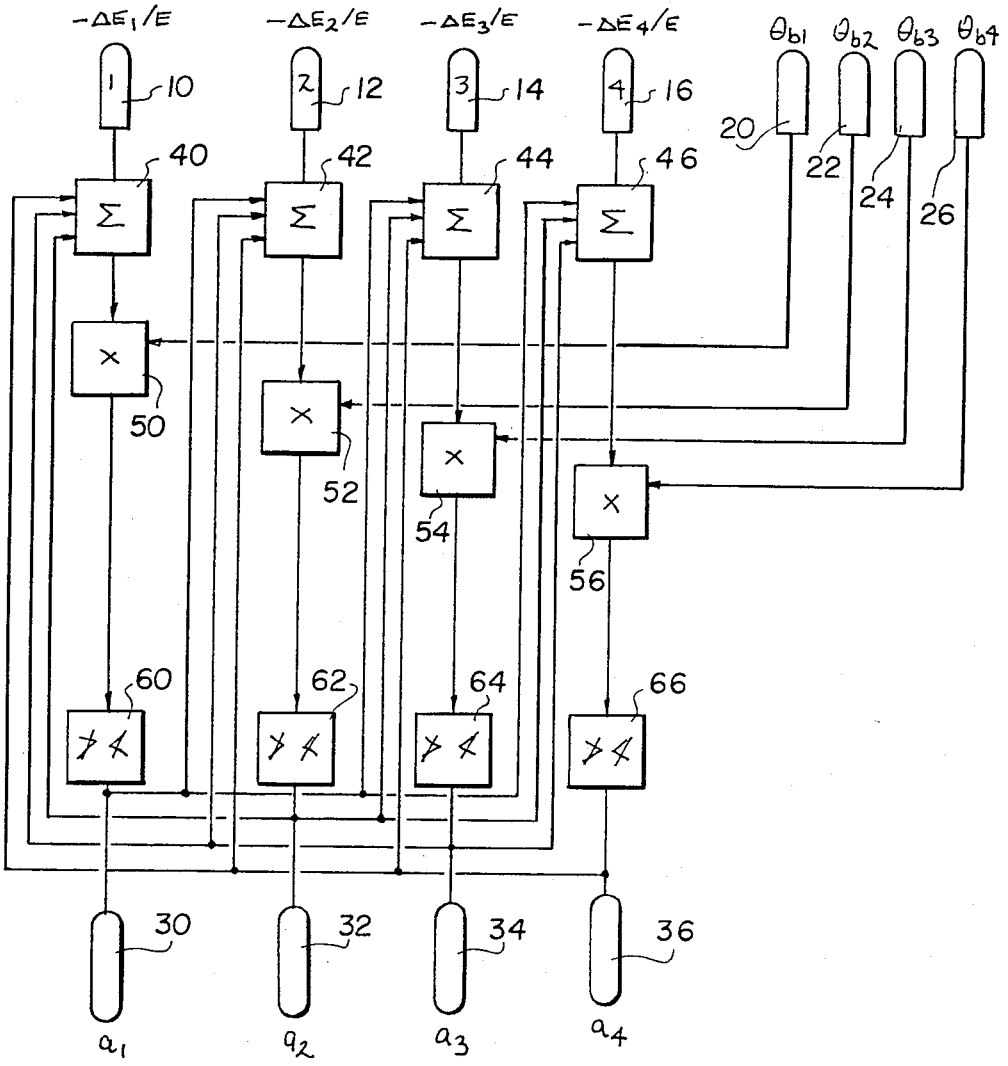
FIGS. 6 and 7 are block diagrams illustrating how the method of the invention can be implemented.
Figure 7:
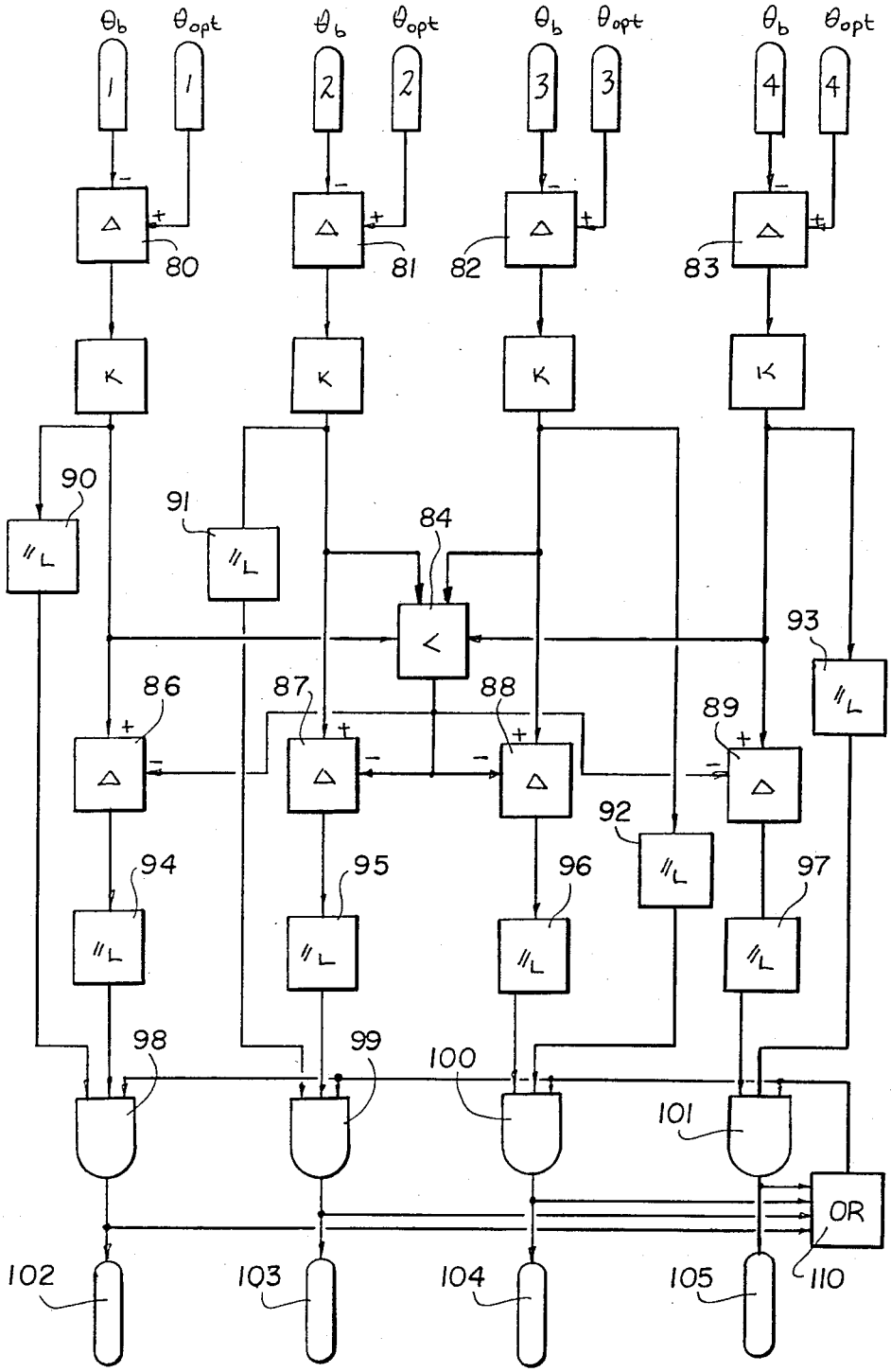
Figure 6:
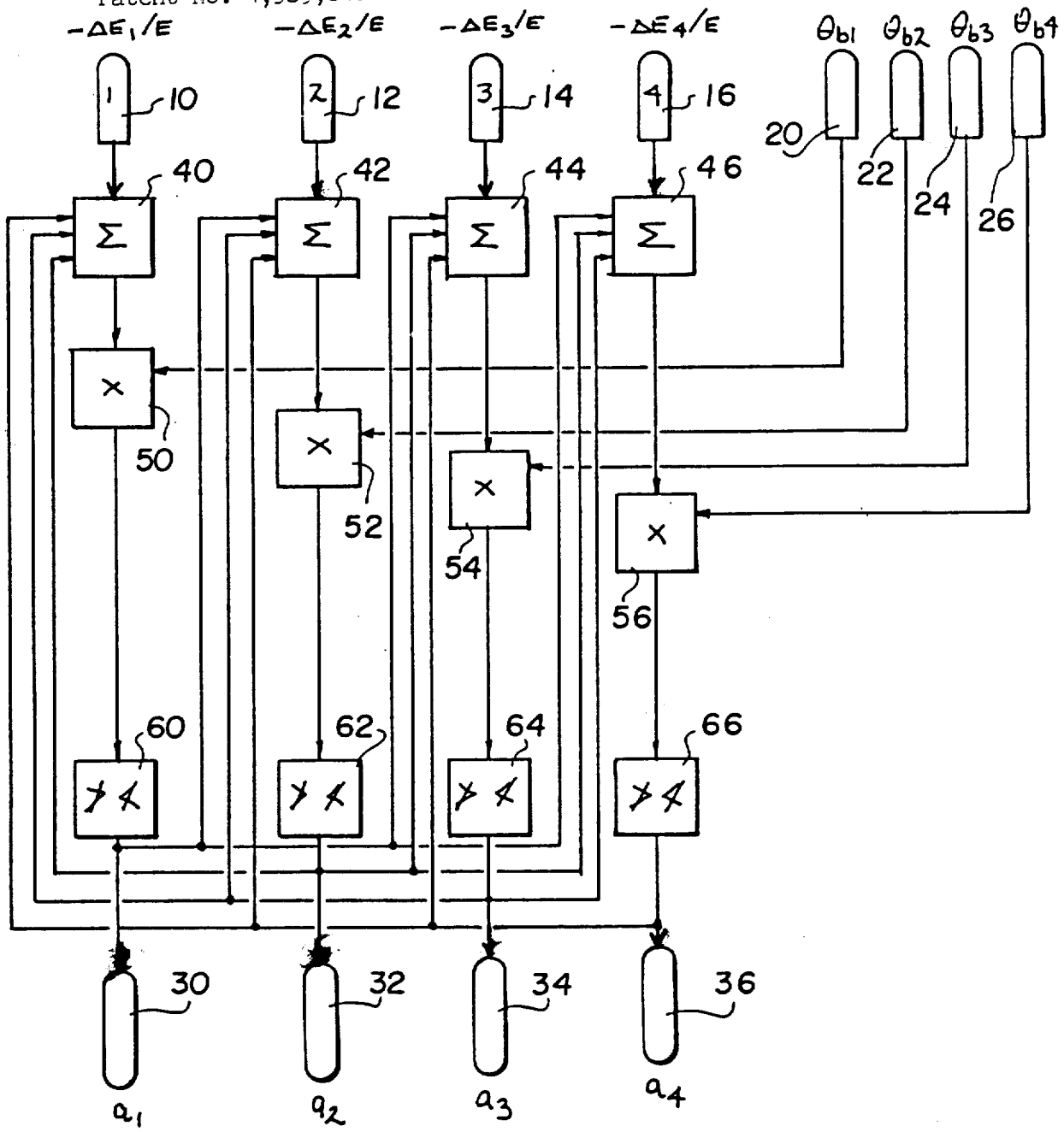

As shown in FIG. 6, conventional equipment such as temperature and oxygen sensors can be utilized to establish the ratio $\Delta E_i/E$ in units 10, 12, 14, and 16, for each of four heat traps where i-1, 2, 3, or 4. Suitable sensors and timers (not shown) can also be utilized to determine the times since last sootblowing in each heat trap, as illustrated at units 20, 22, 24, and 26.

In addition, this method by induction is also valid for sequencing singular sootblowers given sensitivities of fouling rates within individual heat traps.

At the output of the operating logic circuit illustrated in FIG. 6, the model parameters $a_1$, $a_2$, $a_3$, and $a_4$, are generated at output units 30, 32, 34, and 36.

The logic circuit includes summing units 40, 42, 44, and 46 which receive the output of the respective efficiency units 10 through 16 and sum these outputs to a factor from each of the other heat traps. The output of summing units 40 through 46 are multiplied by the appropriate time period for the respective heat traps in multiplication units 50, 52, 54, and 56. Limiters 60, 62, 64, and 66 are then provided to generate the parameter information and the factor to be added in the summing unit of each other heat trap. This logic circuitry performs a solution to a set of linear equations using a recursive technique.

Parameter identification as set forth above can be utilized to optimize the sootblowing operation for each heat trap of group in accordance with the above-identified application for sootblowing optimization.

According to that application, a set value for the time $\theta_b$ between sootblowing operations is compared to an optimum value $\theta_{opt}$. The optimum cycle value $\theta_{opt}$ is attained as a function, not only of fouling and lost efficiency, but also a cost factor for the sootblowing operation. Specifically, one minimizes the expression of average loss:

$$= \left( \int_0^{\theta_b} at^{\mu}dt + \int_{\theta_b}^{\theta_b+\theta_c} b\cdot(\theta_b + \theta_c - t)dt + S\theta_c \right) \times \frac{1}{\theta_b + \theta_c}$$

In the case of a linear fouling rate ($\mu=1$, as depicted in FIG. 1) $\theta_{bopt}$ may be found explicitly:

$$\theta_{bopt} = \sqrt{\frac{2S\cdot\theta_c}{a}} - \theta_c$$

This optimum cycle time ($\theta_{bopt}$) reflects economic considerations that affect the overall operation of the generating unit and is easily calculated.

According to the above-identified application, three conditions were to be met before sootblowing operation in one of a plurality of heat traps was initiated. These conditions were:

(a) no other sootblower is currently active (b) the difference between set and optimum cycle time ($\theta_b$-$\theta_{opt}$) is sufficiently low, and (c) if condition (b) exists for more than one heat trap, the heat trap at the lowest value is chosen.

While specific embodiments of the invention have been shown and described in detail to illustrate the application of the principles of the invention, it will be understood that the invention may be embodied otherwise without departing from such principles.

We claim:

1. A method of identifying a parameter ($a_i$) of a model for a rate of loss of boiler efficiency due to a sootblowing operation in one of a plurality of heat traps in the boiler, comprising:

measuring a time ($\theta_{bi}$) since a last sootblowing operation in the $i^{th}$ heat trap;

measuring an overall boiler efficiency (E) at a beginning of a sootblowing operation for the $i^{th}$ heat trap;

measuring the change in efficiency ($\Delta E_i$) in the boiler due to the sootblowing operation in the $i^{th}$ heat trap; and calculating the parameter ($a_i$) using the equation: for i-1, $$M - \frac{\Delta E_i}{E} = a_i\theta_{bi}^{Ni} - \sum_{\substack{j=1\\ j\neq i}}^{m} a_j((T_i\,\theta_{ci})^{Nj} - T_j^{Nj})$$

where, $N_i$=a coefficient for fouling rate in the model of the $i^{th}$ heat trap M is the number of heat traps in the boiler $\theta_{ci}$=time for sootblowing in the $i^{th}$ heat trap $a_i$=a model parameter for the $i^{th}$ heat trap, and $T_h$=the time since sootblowing in the $j^{th}$ heat trap.

2. A method accordinng to claim 1, wherein the model for a rate of loss of boiler efficiency is of the form above and rises from the termination of the sootblowing operation to the beginning of a subsequent sootblowing operation over the sootblowing time ($\theta_{bi}$) and falls from the beginning of a subsequent sootblowing operation to the end of the subsequent sootblowing operation during a sootblowing time ($\theta_{ci}$).

3. A method according to claim 1, wherein the overall efficiency and change in efficiency is a composite of the boiler efficiency for each of the plurality of heat traps.

4. A device for identifying a parameter ($a_i$) of a model for a rate of loss of boiler efficiency due to a sootblowing operation in one of a plurality of heat traps in a boiler, comprising:

means for measuring the time since a last sootblowing operation in the $i^{th}$ heat trap ended ($\theta_{bi}$);

means for measuring an overall boiler efficiency (E) at a beginning of a sootblowing operation for the $i^{th}$ heat trap;

means for measuring a change in efficiency ($\Delta E_1$) in the boiler due to the sootblowing operation in the $i^{th}$ heat trap; and means for calculating the parameter ($a_i$) using the equation: for i=1, $$M - \frac{\Delta E_i}{E} = a_i\theta_{bi}^{Ni} - \sum_{\substack{j=l \\ j\neq i}}^{m} a_j((T_j + \theta_{ci})^{Nj} - T_j^{Nj})$$

where, $N_i$=a coefficient for fouling rate in the model of the $l^{th}$ heat trap M=the number of heat traps in the boiler $\theta_{ci}$=time for sootblowing in the $i^{th}$ heat trap $a_i$=a model parameter for the $i^{th}$ heat trap, and $T_j$=the time since sootblowing in the $j^{th}$ heat trap.

5. A method of optimizing a sootblowing operation in a boiler having a plurality of heat traps lying in series along a gas flow path by sootblowing only one heat trap at one time comprising;

selecting a set time ($\theta_{bi}$) between sootblowing operations of each heat trap;

calculating an optimum time ($\theta_{opt}$) between sootblowing operations of each heat trap based on scaling parameters and a cost factor for the sootblowing operation;

obtaining a difference value between set and optimum time for each heat trap;

comparing the difference value for each heat trap with a selected value which is indicative of the desirability for initiating a sootblowing operation for each heat trap; and initiating the sootblowing operation only in the heat trap having the lowest difference value between heat traps indicated as desirable for initiating a sootblowing operation.

6. A method according to claim 5, including initiating sootblowing in a heat trap only when sootblowing is not taking place in any other heat trap.

* * * * *

UNITED STATES PATENT AND TRADEMARK OFFICE

CERTIFICATE OF CORRECTION

PATENT NO. : 4,539,840 Page 1 of 2

DATED : September 10, 1985

INVENTOR(S) : John H. Klatt & Thomas J. Scheib

It is certified that error appears in the above-identified patent and that said Letters Patent is hereby corrected as shown below:

Figure 6 of the drawings should be deleted to appear as per attached Figure 6.

Column 3, line 64, change "rain" to --ran--.

Column 6, line 51, change "$T_h$" to --$T_j$--.

Signed and Sealed this

Thirteenth Day of January, 1987

*Attest:*

DONALD J. QUIGG

*Attesting Officer* *Commissioner of Patents and Trademarks*

UNITED STATES PATENT AND TRADEMARK OFFICE

CERTIFICATE OF CORRECTION

PATENT NO. : 4,539,840

DATED : September 10, 1985

INVENTOR(S) : John H. Klatt & Thomas J. Scheib

It is certified that error appears in the above-identified patent and that said Letters Patent are hereby corrected as shown below:

Column 7, line 14, in the formula change "j=1" to --j=1--.

Column 7, line 19, change "$1^{th}$" to --$i^{th}$--.

Signed and Sealed this

Fourteenth Day of April, 1987

*Attest:*

DONALD J. QUIGG

*Attesting Officer*

*Commissioner of Patents and Trademarks*